US009551309B2

(12) United States Patent
Filippi et al.

(10) Patent No.: US 9,551,309 B2
(45) Date of Patent: Jan. 24, 2017

(54) FLUID INJECTOR AND METHOD FOR OPERATING A FLUID INJECTOR

(71) Applicant: Continental Automotive GmbH, Hannover (DE)

(72) Inventors: Stefano Filippi, Castel' Anselmo Collesalvetti (IT); Mauro Grandi, Leghorn (IT); Francesco Lenzi, Leghorn (IT); Valerio Polidori, Leghorn (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 425 days.

(21) Appl. No.: 14/293,581

(22) Filed: Jun. 2, 2014

(65) Prior Publication Data

US 2015/0040869 A1 Feb. 12, 2015

(30) Foreign Application Priority Data

Aug. 9, 2013 (EP) ..... 13179898

(51) Int. Cl.
*F02M 51/06* (2006.01)
*F02M 65/00* (2006.01)
(Continued)

(52) U.S. Cl.
CPC ..... *F02M 51/0621* (2013.01); *F02D 41/20* (2013.01); *F02D 41/247* (2013.01);
(Continued)

(58) Field of Classification Search
CPC ..... F02M 51/0617; F02M 51/0621; F02M 65/005; F02M 2200/08; F02M 2200/9053; F02D 41/20; F02D 41/247; F02D 2041/2051; F02D 2041/2055; F02D 2041/2079; F02D 2200/063
See application file for complete search history.

(56) References Cited

U.S. PATENT DOCUMENTS 5,992,391 A * 11/1999 Yamakado ..... F02D 41/20 123/490
6,332,453 B1 * 12/2001 Yamakado ..... F02D 41/20 123/490
(Continued)

FOREIGN PATENT DOCUMENTS

EP 1013920 A2 6/2000 ..... F02D 41/20
EP 1522699 A2 4/2005 ..... F02D 41/20
(Continued)

OTHER PUBLICATIONS

European Search Report and Written Opinion, Application No. 13179898.5, 6 pages, Dec. 12, 2013.

*Primary Examiner* — Darren W Gorman
(74) *Attorney, Agent, or Firm* — Slayden Grubert Beard PLLC

(57) ABSTRACT

A fluid injector includes a valve body, a valve needle and axially moveable in the valve body between a closing position that prevents a fluid injection and further positions that permit the fluid injection, an armature coupled to the valve needle for displacing the valve needle away from the closing position, and a solenoid assembly including at least a first and second coil and operable to magnetically actuate the armature via an electrical signal. A method for operating the fluid injector includes applying the electrical signal to the first coil to generate a magnetic field to move the armature for displacing the valve needle away from the closing position, evaluating a voltage across terminals of the first coil, and controlling the second coil with a further electrical signal to saturate a magnetic field in a portion of the valve body between the armature and solenoid assembly during evaluating the voltage.

20 Claims, 3 Drawing Sheets

(51) Int. Cl.
*F02D 41/20* (2006.01)
*F02D 41/24* (2006.01)

(52) U.S. Cl.
CPC ..... *F02M 51/0617* (2013.01); *F02M 65/005* (2013.01); *F02D 2041/2051* (2013.01); *F02D 2041/2055* (2013.01); *F02D 2041/2079* (2013.01); *F02D 2200/063* (2013.01); *F02M 2200/08* (2013.01); *F02M 2200/9053* (2013.01)

(56) References Cited

U.S. PATENT DOCUMENTS

| | | | | |
|---|---|---|---|---|
| 6,386,467 | B1 * | 5/2002 | Takeda | F02M 51/0617 239/585.1 |
| 6,392,865 | B1 * | 5/2002 | Fochtman | F02M 51/0621 239/585.1 |
| 6,834,844 | B1 * | 12/2004 | Hamada | F02D 41/20 123/490 |
| 7,021,568 | B2 | 4/2006 | Rieger et al. | 239/585.1 |
| 2002/0130192 | A1 | 9/2002 | Mccoy et al. | 239/5 |
| 2012/0104112 | A1 * | 5/2012 | Grandi | F02D 41/20 239/11 |
| 2013/0104636 | A1 | 5/2013 | Beer et al. | 73/114.49 |

FOREIGN PATENT DOCUMENTS

| | | | | |
|---|---|---|---|---|
| JP | 59224464 | A | 12/1984 | F02M 51/06 |
| WO | 01/57390 | A1 | 8/2001 | F01L 9/04 |
| WO | 2011/000663 | A1 | 1/2011 | F02D 41/20 |

* cited by examiner (State of the art)

$I_1$
$T_1$
t
$I_2$
$T_2$
t
$U_1$
$T_e$
t

FLUID INJECTOR AND METHOD FOR OPERATING A FLUID INJECTOR

CROSS-REFERENCE TO RELATED APPLICATIONS

This application claims priority to EP Patent Application No. 13179898 filed Aug. 9, 2013. The contents of which are incorporated herein by reference in their entirety.

TECHNICAL FIELD

The present disclosure relates to a fluid injector, comprising a longitudinal axis, a valve needle, being axially moveable and being operable to prevent a fluid injection in a closing position and to permit the fluid injection in further positions, an armature being mechanically coupled to the valve needle, and a solenoid assembly comprising at least a first and second coil and being operable to magnetically actuate the armature via an electrical signal. The present disclosure further relates to a method for operating the fluid injector.

BACKGROUND

Fluid injectors are in widespread use, in particular for internal combustion engines where they may be arranged in order to dose fluid into an intake manifold of the internal combustion engine or directly into the combustion chamber of a cylinder of the internal combustion engine.

In order to enhance the combustion process in view of the creation of unwanted emissions, the respective fluid injector may be suited to dose fluids under very high pressures. The pressures may be in case of a gasoline engine, for example, in the range of up to 200 bar and in the case of diesel engines in the range of up to 2000 bar.

WO 2011/000663 A1 discloses a fluid injector comprising a longitudinal axis and a valve needle, which is axially moveable and operable to prevent a fluid injection in a closing position and to permit the fluid injection in further positions. The fluid injector also comprises an armature being mechanically coupled to the valve needle, and a solenoid assembly which comprises at least a first and second coil and which is operable to magnetically actuate the armature via an electrical signal applied to at least one predetermined assortment of the at least two coils. This enables an adjustment of the fluid injection to the current operating conditions, in particular a fluid pressure, of the fluid injector. Applying the electrical signal on a first predetermined assortment comprising more than one coil contributes to increasing the solenoid inductance and the magnetic force acting on the armature. This permits the fluid injection in a fast manner. On the other hand, if the fluid pressure within the fluid injector is relatively low the electrical signal may be applied to a second predetermined assortment comprising less coils than the first assortment. This reduces e.g. ohmic drops due to reduced resistance and contributes to ensuring an efficient operation of the fluid injector.

Due to always more stringent requirements, the solenoid injector must be controllable in order to deliver very small fuel quantities. In particular, this is true for solenoid injectors under so called ballistic operating mode. To control the injector, an electrical feedback signal is used to detect the movement changes of an injector armature when the armature-needle assembly reaches a fully opened and a fully closed position. Evaluating this signal with an appropriated controlling unit makes it possible to control minimum dispensable fuel delivery quantities. The electrical feedback signal is measured between the terminals of a coil which is used to generate a magnetization of the armature in order to open and close an injector valve.

In order to achieve a good signal quality of the electrical feedback signal available from the injector circuit, the injector body needs to have a restriction (a thin valve body section) in the area of the coil which supports the electrical signal development to detect the closing position of the armature-needle assembly. This design requires that the valve body is made by special "not good" magnetic steel, for example 415M SS, with limited saturation level at around 1 Tesla. As a disadvantage, this has the effect that the electrical signal amplitude will be reduced. Nevertheless, a valve body having a section with reduced thickness must accomplish all requirements coming with regard to the structural resistance. Hence, the material of the valve body must also support higher mechanical stresses.

SUMMARY

One embodiment provides a method for operating a fluid injector, wherein the fluid injector has a longitudinal axis and comprises: a valve body, a valve needle, being received in the valve body, being axially moveable and being operable to prevent a fluid injection in a closing position and to permit the fluid injection in further positions, an armature being mechanically coupled to the valve needle so that it is operable to displace the valve needle away from the closing position, a solenoid assembly comprising at least a first and second coil and being operable to magnetically actuate the armature via an electrical signal, wherein the method comprising the following steps: applying the electrical signal to the first coil to generate a primary magnetic field to move the armature for displacing the valve needle away from the closing position, evaluating a voltage across terminals of the first coil, and controlling the second coil with a further electrical signal to saturate a magnetic field in a portion of the valve body which is located between the armature and the solenoid assembly during evaluating the voltage.

In a further embodiment, the voltage is measured at least between a point in time when the electrical signal is terminated and a point in time when the valve needle reaches the closing position.

In a further embodiment, the method further comprises a step of evaluating the voltage during one injection event of the fluid injector and using the evaluation result as a feedback signal for controlling the electrical signal in a subsequent injection event.

In a further embodiment, the further electrical signal through the second coil is phased with the electrical signal through the first coil in order to optimize global power consumption.

Another embodiment provides a fluid injector having a longitudinal axis, comprising: a valve body, a valve needle, being received in the valve body, being axially moveable and being operable to prevent a fluid injection in a closing position and to permit the fluid injection in further positions, an armature being mechanically coupled to the valve needle so that it is operable to displace the valve needle away from the closing position, a solenoid assembly comprising at least a first and second coil and being operable to magnetically actuate the armature via an electrical signal, wherein the fluid injector is configured: for feeding the electrical signal to the first coil to generate a primary magnetic field to move the armature for displacing the valve needle away from the closing position, and for controlling the second coil to saturate a magnetic field in a portion of the valve body which is located between the armature and the solenoid assembly in order to have a constant magnetic flux in the valve body during evaluating a voltage across terminals of the first coil.

In a further embodiment, the fluid injector further comprises a calibration spring for biasing the valve needle towards the closing position, wherein the fluid injector is configured to feed a further electrical signal to the second coil while the first coil is de-energized and the valve needle is moved towards the closing position by a spring force generated by the calibration spring.

In a further embodiment, the second coil is electrically separated from the first coil.

In a further embodiment, the first coil and the second coil are controllable separately from each other.

In a further embodiment, the second coil overlaps axially with a portion of the valve body which has a reduced thickness.

In a further embodiment, the second coil overlaps axially with the first coil.

In a further embodiment, the second coil is located between a portion of the first coil and the valve body.

In a further embodiment, the second coil is located within a U-shaped profile the open end of which is directed toward the valve body.

In a further embodiment, the profile is made from a ferromagnetic material.

BRIEF DESCRIPTION OF THE DRAWINGS

Example embodiments of the fluid injector and the method are described below with reference to the figures, in which.

DETAILED DESCRIPTION

Figure 1:
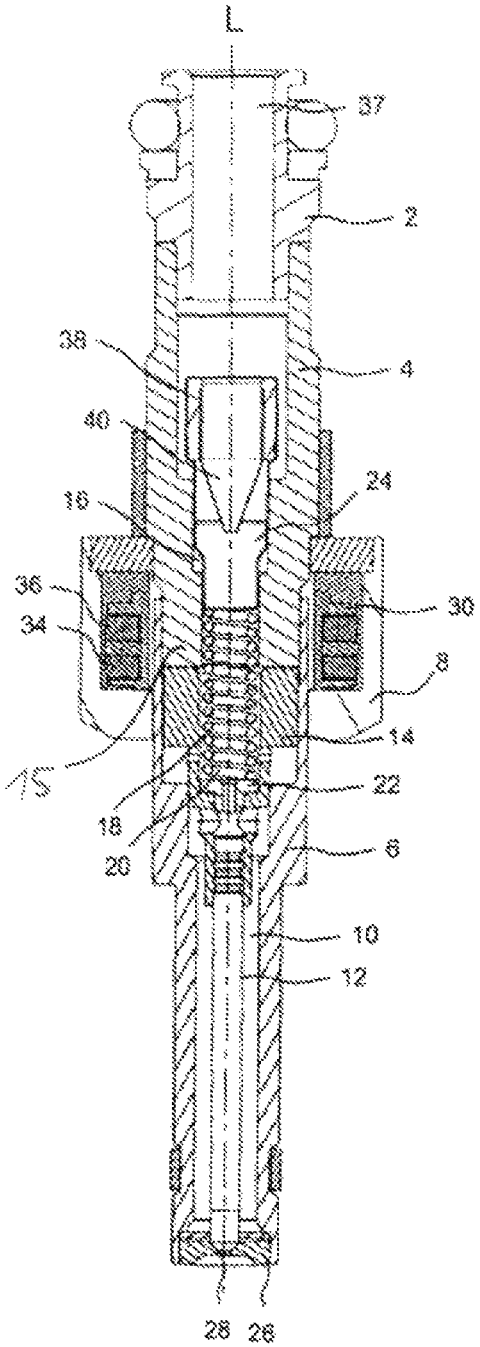
FIG. 1 shows a known fluid injector having two coils.

Embodiments of the invention to provide a fluid injector which facilitates a reliable and efficient fluid injection by improved controlling possibilities. It is another object of the invention to specify a method for operating a fluid injector which allows injection of particularly small fluid quantities.

According to a first aspect, a fluid injector is specified. According to a second aspect, a method for operating the fluid injector is specified.

The fluid injector has a longitudinal axis and comprises a valve needle, which is received in a valve body and axially moveable. The valve needle is operable to prevent fluid injection in a closing position and to permit fluid injection in further positions. The fluid injector also comprises an armature being mechanically coupled to the valve needle, and a solenoid assembly which comprises at least a first and second coil and which is operable to magnetically actuate the armature via an electrical signal. The armature is preferably received in the valve body.

The armature is in particular axially moveable with respect to the valve body and operable to displace the valve needle away from the closing position. The armature can be either rigidly coupled to the valve needle, i.e. it can be positionally fixed with respect to the valve needle, or the armature and the valve needle can be coupled with a certain axial play so that the armature and the valve needle are axially displaceable with respect to each other.

The fluid injector may further comprise a calibration spring which is operable to bias the valve needle towards the closing position. The valve needle and the armature are in particular coupled such that the valve needle is operable to take the armature with it when it is moved axially towards the closing position by means of the spring force generated by the calibration spring.

The fluid injector is in particular configured for feeding the electrical signal to the first coil to generate a primary magnetic field to move the armature for displacing the valve needle away from the closing position. The fluid injector is in particular further configured such that the second coil is controllable to saturate a magnetic field in a portion of the valve body which is located between the armature and the solenoid assembly, preferably in order to have a constant magnetic flux in the valve body during evaluating a voltage across terminals of the first coil. The voltage may represent a feedback signal which is preferably used for controlling the electrical signal.

According to one embodiment, the electrical signal is applied to the first coil to generate a primary magnetic field to move the armature for displacing the valve needle away from the closing position, while the second coil is controlled to saturate a magnetic field in the portion of the valve body which is located between the armature and the solenoid assembly in order to have a constant magnetic flux in the valve body during evaluating a voltage across terminals of the first coil, the voltage representing a feedback signal used for controlling the electrical signal. The feedback signal is in particular measured during the closing transient of the fluid injector, i.e. in particular in the time period between the end of the electrical signal fed to the first coil and the return of the valve needle to the closing position.

In one embodiment, the method comprises a step of applying the electrical signal to the first coil to generate a primary magnetic field to move the armature for displacing the valve needle away from the closing position. The method further comprises a step of evaluating the voltage across the terminals of the first coil. The method additionally comprises a step of controlling the second coil with a further electrical signal to saturate a magnetic field in the portion of the valve body which is located between the armature and the solenoid assembly during evaluating the voltage.

In one embodiment of the method, the voltage is measured at least between a point in time when the electrical signal is terminated and a point in time when the valve needle reaches the closing position.

In one embodiment, the method further comprises a step of evaluating the voltage during one injection event of the fluid injector and using the evaluation result as a feedback signal for controlling the electrical signal in a subsequent injection event.

In one embodiment of the method, the further electrical signal through the second coil is phased with the electrical signal through the first coil in order to optimize global power consumption.

Embodiments of the invention make use of the idea that the electrical feedback signal is proportional to the magnetic flux variation caused by the velocity change of the armature. Hence, to maximize the armature motion contribution on the feedback signal, it has to be ensured that there the variation of the magnetic flux in the valve body during measuring the feedback signal is as small as possible. This is realized by providing the second coil which ensures that there is no influence of the flux passing through the valve body. As a result, the feedback signal which is derived from the terminals of the first coil is improved in its quality.

The fluid injector may comprise a pole piece which is integrally formed with the valve body or positionally fixed with respect to the valve body. The pole piece makes part of a magnetic circuit for the first magnetic field. The armature may be attracted towards the pole piece when the first coil is energized by the electrical signal. The fluid injector may be configured such that the armature abuts the pole piece in a fully open configuration of the fluid injector and is axially spaced apart from the armature when the needle is in the closed position, i.e. an axial working gap may be present between the pole piece and the armature. The method may comprise terminating the electrical signal before the fluid injector reaches the fully open configuration.

According to an embodiment, the second coil is electrically separated from the first coil. In particular, the first coil and the second coil may be controlled separately from each other. For example, when the electrical current of the first coil is zero—in particular at the end of the electrical signal—(so called final clamping), the second coil is activated with continuous voltage step (i.e. 5V) until the voltage of the first coil is zero. The controlling can be done by the control unit.

The second coil may overlap axially with a portion of the valve body which has a reduced thickness. This portion of the valve body is part of a path of the magnetic flux which will be kept constant due to the existence of the second coil. In one development, the second coil, the portion of the valve body having the reduced thickness and the axial working gap overlap one another in longitudinal direction. In this way, a particularly good signal quality of the feedback signal is achievable.

In a further embodiment, the second coil may overlap axially with the first coil. This ensures small dimensions of the solenoid assembly. In particular, the second coil may be located between a portion of the first coil and the valve body. This arrangement ensures small dimensions of the solenoid assembly, too. In the section of overlapping with the second coil, the first coil may have a reduced thickness so that the second coil can be placed in the resulting recess. For example the thickness—i.e. in particular the difference between the inner and the outer diameter of the coil—of a further portion which is located subsequent to the second coil in longitudinal direction may be at least twice as large as the thickness of the portion overlapping with the second coil. In one development, the first coil has a smaller number of windings which succeed one another in radial direction in the portion where it overlaps axially with the second coil than in the further portion. For example, the number of radially subsequent windings in the further portion is at least twice as large as in the portion overlapping with the second coil.

According to a further embodiment, the second coil is located within a U-shaped profile whose open end is directed toward the valve body. In other words, the profile may be a body of revolution resulting from—imaginary—rotation of a U-shape around the longitudinal axis, the free ends of the U-shape facing towards the longitudinal axis. By means of the U-shape, the profile in particular comprises a channel which is open in radially inward direction and in which the second coil may be received. The profile may be made from a ferromagnetic material, in particular to provide a dedicated path of the magnetic flux of the second coil. The U-shaped profile is part of the path of the magnetic flux which will be kept constant due to the existence of the second coil. In addition, the profile houses the conductors of the second coil.

In a further embodiment, a current flowing through the second coil is phased with a current flowing through the first coil in order to optimize global power consumption. For example, the second coil may be operated with a further electrical signal in addition to the first coil when the electrical signal is fed to the first coil. The electrical signal and the further electrical signal may be pulsed signals which have a phase shift with respect to each other. When the electrical current of the first coil is zero (so called final clamping), the second coil may be activated with continuous voltage step (i.e. 5V) until the voltage of the first coil is zero. The controlling can be done by the control unit.

FIG. 1 shows a cross-sectional view of a known fluid injector. The fluid injector is in particular suited for dosing fluid, in particular fuel, into an internal combustion engine. It comprises a fitting adapter 2 being designed to mechanically and hydraulically couple the fluid injector to a fluid reservoir, such as a fuel rail. The fluid injector has a longitudinal axis L and further comprises an inlet tube 4, a valve body 6 and a housing 8. A recess 10 is provided in the valve body 6 which takes in a valve needle 12 and preferably an armature 14.

The valve needle 12 is mechanically coupled to the armature 14. In case of the valve needle according to FIG. 1, the armature 14 is rigidly coupled to the valve needle 12 so that they are positionally fix with respect to one another.

The inlet tube 4 is provided with a recess 16 which hydraulically communicates with the recess 10 of the valve body 10 through a central opening 18 of the armature 14. A spring 20 is arranged in the recess 16 of the inlet tube 4. The spring 20 may extend into the central opening 18 of the armature 14. In one embodiment, the spring 20 rests on a spring seat being formed by an anti-bounce disk 22 in the central opening 18 of the armature 14. The spring 20 is in this way mechanically coupled to the valve needle 12. An adjusting tube 24 is provided in the recess 16 of the inlet tube 4. The adjusting tube 24 forms the further seat for the spring 20 and may—during the manufacturing process of the fluid injector be axially—moved in order to preload the spring 20 in a desired way.

In a closing position of the fluid injector, the valve needle 12 sealingly rests on a seat 26 and prevents in this way a fluid flow through at least one injection nozzle 28. The injection nozzle 28 may, for example, be an injection hole, it may, however, also be of some other type suitable for dosing fluid. The seat 26 may be made as one part with the valve body 6 or may also be made as a separate part fixed to the valve body 6. A fluid injection is permitted, when the valve needle 12 is in further positions, displaced away from the closing position in axial direction L against the bias of the spring 20. The fluid injector is in a fully open configuration when the armature 14 abuts a pole piece 15 which in the present case is represented by a downstream end of the inlet tube 4. When the valve needle is in the closed position, the armature 14 is spaced apart from the pole piece 15, i.e. from the inlet tube 4 in the present case, in longitudinal direction L. In this way, an axial working gap is defined between the armature 14 and the pole piece 15.

The fluid injector comprises a solenoid assembly 30 with a first and second coil 34, 36. The first and second coils 34, 36 are preferably overmolded. The solenoid assembly 30 may comprise more than two coils.

A fluid inlet 37 is provided in the fitting adapter 2 which is received in the recess 16 at an upstream end of the inlet tube 4. The fluid inlet 37 communicates with a filter 38 through which the fluid has to pass on its way from the recess 16 of the inlet tube 4 to the recess 10 of the valve body 6.

The filter 38 may be integrated in the adjusting tube 24. The adjusting tube 24 is designed such that fluid may flow through the adjusting tube 24 towards the injection nozzle 28. The anti-bounce disk 22 is provided with an appropriate recess which communicates hydraulically with the central opening of the armature 14. The adjusting tube 24 is provided with a damper 40 for dampening the fluid flow. The damper 40 comprises at least one orifice, through which the fluid must flow when flowing from the fluid inlet 37 of the fluid injector to the at least one injection nozzle 28.

Figure 2:
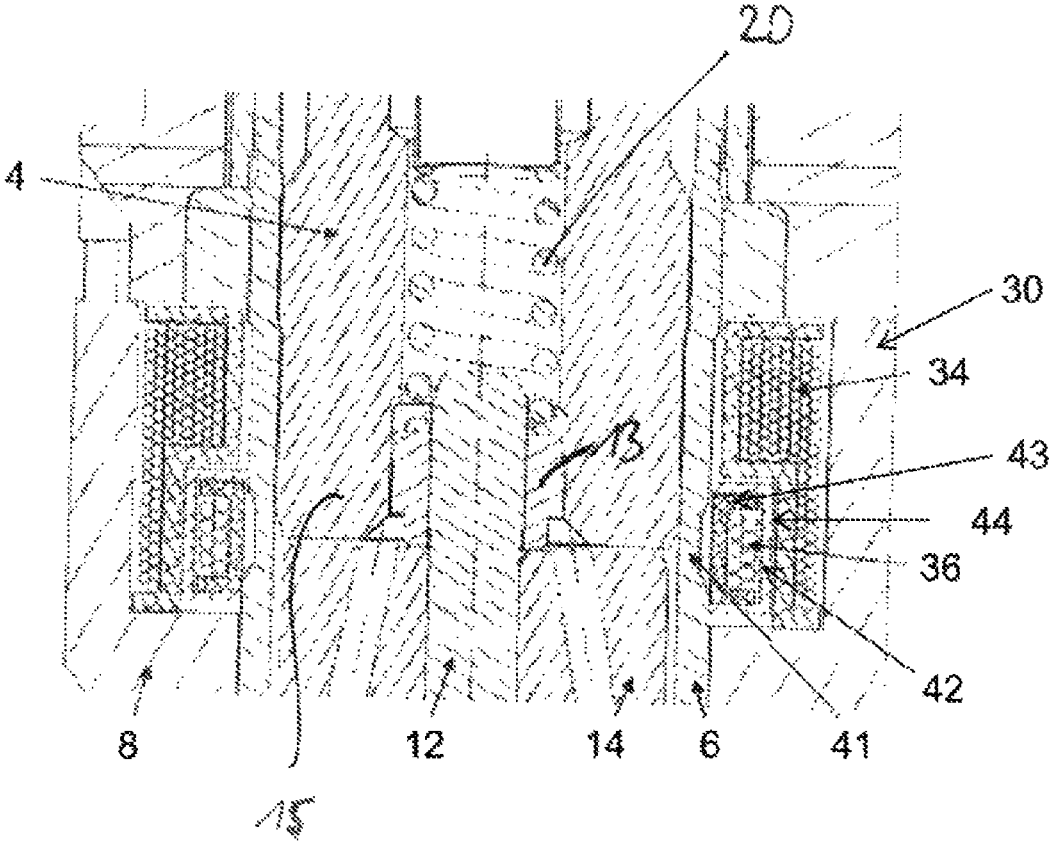
FIG. 2 shows an enlarged view of an injector according to an exemplary embodiment of the invention illustrating the solenoid according to the invention.

FIG. 2, shows a cross-sectional view of a portion of a fluid injector according to an exemplary embodiment of the invention. The fluid injector corresponds in general to the fluid injector of FIG. 1.

Contrary to the fluid injector of FIG. 1, the armature 14 of the fluid injector according the present embodiment is axially displaceable with respect to the valve needle 12. The valve needle 12 has a collar 13 at an upstream end which limits the relative axial displacement of the armature 14 with respect to the valve needle 12 in axial direction away from the seat 26. In this way, the armature 14 is operable to take the valve needle 12 with it when it moves away from the seat 26. The spring 20 in the present embodiment does not engage the armature 14 as in FIG. 1 but rests on the collar 13 of the valve needle 12. The collar 13 is received in a central bore of the pole piece 15 for guiding the valve needle 12 in longitudinal direction.

Further, in contrast to the fluid injector of FIG. 1, the valve body 6 comprises an optional section 41 having a reduced thickness. The section 41 axially overlaps the axial working gap between the armature 14 and the pole piece 15.

The solenoid assembly 30 including the first and the second coil 34, 36 surrounds the valve body 6 within the range of the section 41. More detailed, the second coil 36 is arranged adjacent the section 41 and overlaps axially with it at least partially. The second coil 36 is located within a first U-shaped profile 42 made from a ferromagnetic material, such as stainless steel having the steel grade 430 or 415 in the SAE classification. The conductors of the second coil 36 are arranged in a bobbin 43 having a second U-shaped profile and in particular being made from the material of the internal housing which is arranged in the first U-shaped profile 42. The bottom side of the bobbin 43—i.e. the surface facing towards the longitudinal axis L—is adjacent to the section 41 such that there is a radial gap between the bobbin 43 and the valve body 6.

The second coil 36 overlaps axially with the first coil 34 and is located in a stepped recess 44 of the first coil 34 which has a stepped cross-section. In a portion which precedes the second coil 36 in longitudinal direction L towards the seat 26, the first coil 34 has a smaller inner diameter and more radially subsequent windings than in the portion which axially overlaps with the second coil 36.

The fluid injector is configured to be operated in a so called ballistic operation mode. In the ballistic operation mode, the solenoid assembly 30 may be de-energized before the armature comes into contact with the pole piece 15.

To control the injector, an electrical feedback signal is used to detect the velocity change of the armature 14 when the armature 14 when the armature hits the pole piece 15 and/or when the valve needle 12 hits the seat 26. Evaluating this signal with an appropriated control unit makes it possible to achieve very small minimum fuel delivery quantities. The electrical feedback signal is measured between the terminals (not shown) of the first coil 34 which is used to generate a first magnetic field to move the armature 14 in order to open the injector valve.

Figure 3:
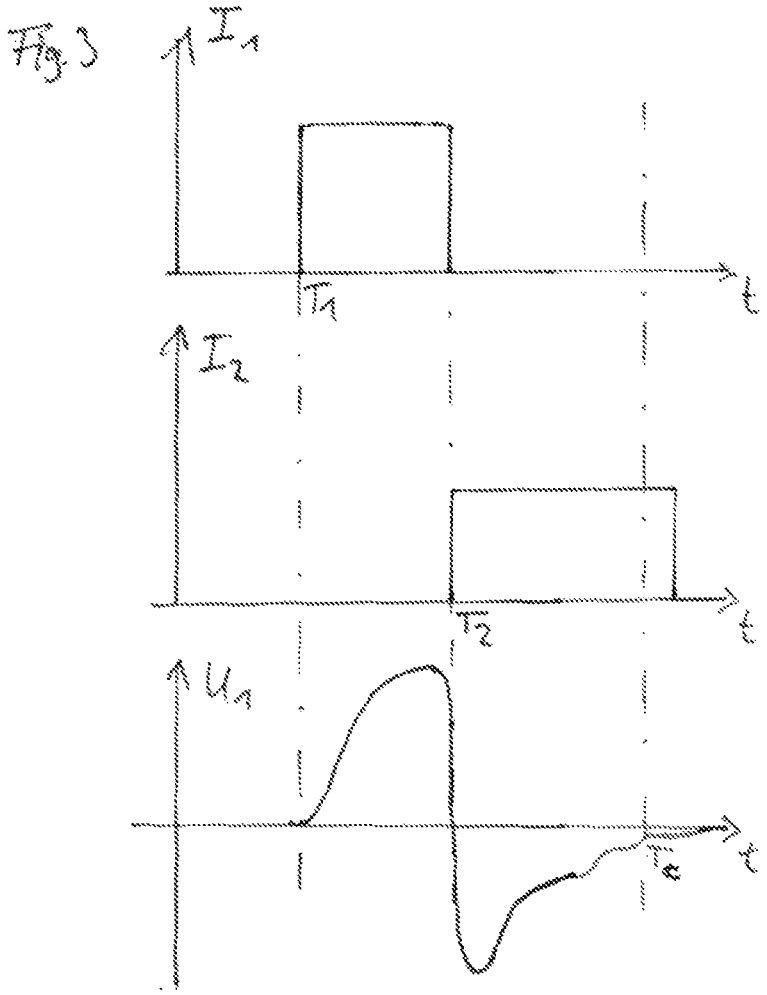
FIG. 3 shows a diagram of the currents through the first and second coils and of the voltage of the first coil of the injector of FIG. 2 in dependence on time during an injection event.

FIG. 3 shows an electrical signal $I_1$ fed into the first coil 34, a further electrical signal $I_2$ which is fed into the second coil 36 and a voltage $U_1$ induced in the first coil 34 in dependence on the time t according to an exemplary embodiment of a method for operating the fluid injector.

In the method according to the exemplary embodiment, the electrical signal $I_1$ is applied to the first coil 34, starting at a point $T_1$ in time t, to generate a primary magnetic field for moving the armature 14 in axial direction L away from the seat 26 (see the upper portion of FIG. 3). The armature, by means of its mechanical coupling to the valve needle 12, takes the valve needle 12 with it in axial direction L. In this way, the valve needle 12 is displaced away from the closing position. The valve needle 12, thus, gets out of contact with the seat 26 so that the fluid injector is unsealed and fluid is dispensed through the injection nozzle 28.

The electrical signal $I_1$ may be controlled to terminate before the fluid injector reaches its fully opened configuration, i.e. before the armature 14 hits the pole piece 15.

When the first coil 34 is de-energized by terminating the electrical signal $I_1$ at a point $T_2$ in time t, the spring 20 forces the valve needle 12 to move back towards the seat 26 in axial direction L until the valve needle 12 hits the seat 26, i.e. until the valve needle 12 reaches the closing position. By means of the mechanical coupling with the armature 14, the valve needle 12 takes the armature 14 with it when moving towards the closing position for re-sealing the injection nozzle 28. By means of the movement of the armature 14 with respect to the first coil 34, a voltage $U_1$ is induced in the first coil 34 (see the lower portion of FIG. 3).

The armature 14 is fixedly coupled to the valve needle 12 or axial displacement of the armature 14 with respect to the valve needle 12 is limited by means of the mechanical coupling of the armature 14 to the valve needle 12. Thus, the velocity of the armature 14 changes when the valve needle 12 hits the seat 26 at a point $T_C$ in time t. The velocity change of the armature 14 changes the voltage $U_1$ which is induced in the first coil 34. In an embodiment of the method, the voltage $U_1$ induced in the first coil 34 is measured and evaluated to detect the point in time when the valve needle 12 hits the seat 26. Evaluating the induction voltage $U_1$ in particular comprises determining the voltage change brought about by the velocity change of the armature 14 when the valve needle 12 hits the seat 26.

The method further comprises a step of controlling the second coil 36 with the further electrical signal $I_2$ (see the middle portion of FIG. 3) to saturate the magnetic field in a portion of the valve body 6 which is located between the armature 14 and the solenoid assembly 30 in order to have a constant magnetic flux in the valve body 6 during evaluating the induction voltage $U_1$ across the terminals of the first coil. Thereby, the path through the section 41 is saturated to avoid and minimize, respectively, a flux variation over the time which may interfere with the voltage induced by the armature 14. As a result, a good quality of the induced voltage signal (which represents the feedback signal) across the first coil due the armature motion can be measured. This provides better support to the injector ballistic operation via the feedback signal.

In one development of the method, the second coil 36 is energized when the first coil 34 is de-energized (see FIG. 3).

In another development of the method, the second coil 36 is already energized before the first coil 34 is de-energized.

What is claimed is:

1. A method for operating a fluid injector having a longitudinal axis and a valve body, a valve needle received in the valve body and axially moveable between a closing position that prevents a fluid injection and further positions that permit the fluid injection, an armature mechanically coupled to the valve needle for displacing the valve needle away from the closing position, and a solenoid assembly having at least a first and second coil and being operable to magnetically actuate the armature via an electrical signal, the method comprising:

applying the electrical signal to the first coil to generate a primary magnetic field to move the armature to thereby displace the valve needle away from the closing position, evaluating a voltage across terminals of the first coil, and controlling the second coil with a further electrical signal to saturate a magnetic field in a portion of the valve body located between the armature and the solenoid assembly during evaluating the voltage.

2. The method of claim 1, comprising measuring the voltage between a point in time when the electrical signal is terminated and a point in time when the valve needle reaches the closing position.

3. The method of claim 1, further comprising:

evaluating the voltage during one injection event of the fluid injector, and using the evaluation result as a feedback signal for controlling the electrical signal in a subsequent injection event.

4. The method of claim 1, wherein the further electrical signal through the second coil is phased with the electrical signal through the first coil to optimize global power consumption.

5. A fluid injector having a longitudinal axis, the fluid injector comprising:

a valve body, a valve needle received in the valve body and axially moveable between a closing position that prevents a fluid injection and further positions that permit the fluid injection, an armature mechanically coupled to the valve needle for displacing the valve needle away from the closing position, and a solenoid assembly comprising at least a first and second coil and operable to magnetically actuate the armature via an electrical signal, wherein the fluid injector is configured to:

feed the electrical signal to the first coil to generate a primary magnetic field to move the armature to thereby displace the valve needle away from the closing position, and control the second coil to saturate a magnetic field in a portion of the valve body located between the armature and the solenoid assembly to provide a constant magnetic flux in the valve body during evaluating a voltage across terminals of the first coil.

6. The fluid injector of claim 5, further comprising a calibration spring that biases the valve needle towards the closing position, wherein the fluid injector is configured to feed a further electrical signal to the second coil while the first coil is de-energized and the valve needle is moved towards the closing position by a spring force generated by the calibration spring.

7. The fluid injector of claim 5, wherein the second coil is electrically separated from the first coil.

8. The fluid injector of claim 5, wherein the first coil and the second coil are controllable separately from each other.

9. The fluid injector of claim 5, wherein the second coil overlaps axially with a portion of the valve body which has a reduced thickness.

10. The fluid injector of claim 5, wherein the second coil overlaps axially with the first coil.

11. The fluid injector of claim 10, wherein the second coil is located between a portion of the first coil and the valve body.

12. The fluid injector of claim 5, wherein the second coil is located within a U-shaped profile, the open end of which is directed toward the valve body.

13. The fluid injector of claim 12, wherein the profile is made from a ferromagnetic material.

14. An internal combustion engine, comprising:

a fluid injector comprising:

a valve body, a valve needle received in the valve body and axially moveable between a closing position that prevents a fluid injection and further positions that permit the fluid injection, an armature mechanically coupled to the valve needle for displacing the valve needle away from the closing position, and a solenoid assembly comprising at least a first and second coil and operable to magnetically actuate the armature via an electrical signal, wherein the fluid injector is configured to:

feed the electrical signal to the first coil to generate a primary magnetic field to move the armature to thereby displace the valve needle away from the closing position, and control the second coil to saturate a magnetic field in a portion of the valve body located between the armature and the solenoid assembly to provide a constant magnetic flux in the valve body during evaluating a voltage across terminals of the first coil.

15. The internal combustion engine of claim 14, the fluid injector further comprising a calibration spring that biases the valve needle towards the closing position, wherein the fluid injector is configured to feed a further electrical signal to the second coil while the first coil is de-energized and the valve needle is moved towards the closing position by a spring force generated by the calibration spring.

16. The internal combustion engine of claim 14, wherein the second coil is electrically separated from the first coil.

17. The internal combustion engine of claim 14, wherein the first coil and the second coil are controllable separately from each other.

18. The internal combustion engine of claim 14, wherein the second coil overlaps axially with a portion of the valve body which has a reduced thickness.

19. The internal combustion engine of claim 14, wherein the second coil overlaps axially with the first coil.

20. The internal combustion engine of claim 19, wherein the second coil is located between a portion of the first coil and the valve body.

* * * * *